US011510304B1

(12) United States Patent
Gu et al.

(10) Patent No.: US 11,510,304 B1
(45) Date of Patent: Nov. 22, 2022

(54) SYSTEM FOR PRODUCING MIXED REALITY ATMOSPHERE EFFECT WITH HDMI AUDIO/VIDEO STREAMING

(71) Applicant: Shenzhen Suishengyang Technology Co., Ltd., Shenzhen (CN)

(72) Inventors: Peide Gu, Yancheng (CN); Wenjian Liang, Guangxi (CN); Yunfei Wu, Shenzhen (CN)

( * ) Notice: Subject to any disclaimer, the term of this patent is extended or adjusted under 35 U.S.C. 154(b) by 0 days.

(21) Appl. No.: 17/722,405

(22) Filed: Apr. 18, 2022

(30) Foreign Application Priority Data

Apr. 1, 2022 (CN) ..... 202210347092.5

(51) Int. Cl.
*H05B 47/19* (2020.01)
*H05B 45/20* (2020.01)

(52) U.S. Cl.
CPC ..... *H05B 47/19* (2020.01); *H05B 45/20* (2020.01)

(58) Field of Classification Search
CPC ..... H05B 47/19; H05B 45/20
See application file for complete search history.

(56) References Cited

U.S. PATENT DOCUMENTS

2013/0198786 A1* 8/2013 Cook ..... H05B 47/19 725/78
2015/0092115 A1* 4/2015 Micewicz ..... H05B 47/165 348/798
2019/0069375 A1* 2/2019 Baker ..... H04N 21/43635
2020/0211478 A1* 7/2020 Gorilovsky ..... G09G 3/34

FOREIGN PATENT DOCUMENTS

WO WO-2021074678 A1 * 4/2021
WO WO-2021160552 A1 * 8/2021
WO WO-2022012959 A1 * 1/2022

* cited by examiner

*Primary Examiner* — Raymond R Chai

(57) ABSTRACT

The present invention discloses a system for producing a mixed reality atmosphere effect with HDMI audio/video streaming, including a CPU, an HDMI hub, an HDMI input, an HDMI output, an MCU LED controller, a wireless transmitter LED controller, a wireless receiver LED controller, an audio information processing DSP, a TV background lamp and an atmosphere lamp. The HDMI hub is connected to the CPU; and the HDMI input and the HDMI output are both connected to the HDMI hub, and the MCU LED controller and the wireless transmitter LED controller are both connected to the CPU. By adopting the system of the present invention, users can enjoy a more immersive atmosphere when watching video content. By acquiring the video content and processing the video content, the TV background lamp and the atmosphere lamp can interact with the atmosphere of the video content, thus providing a more immersive user experience.

18 Claims, 1 Drawing Sheet

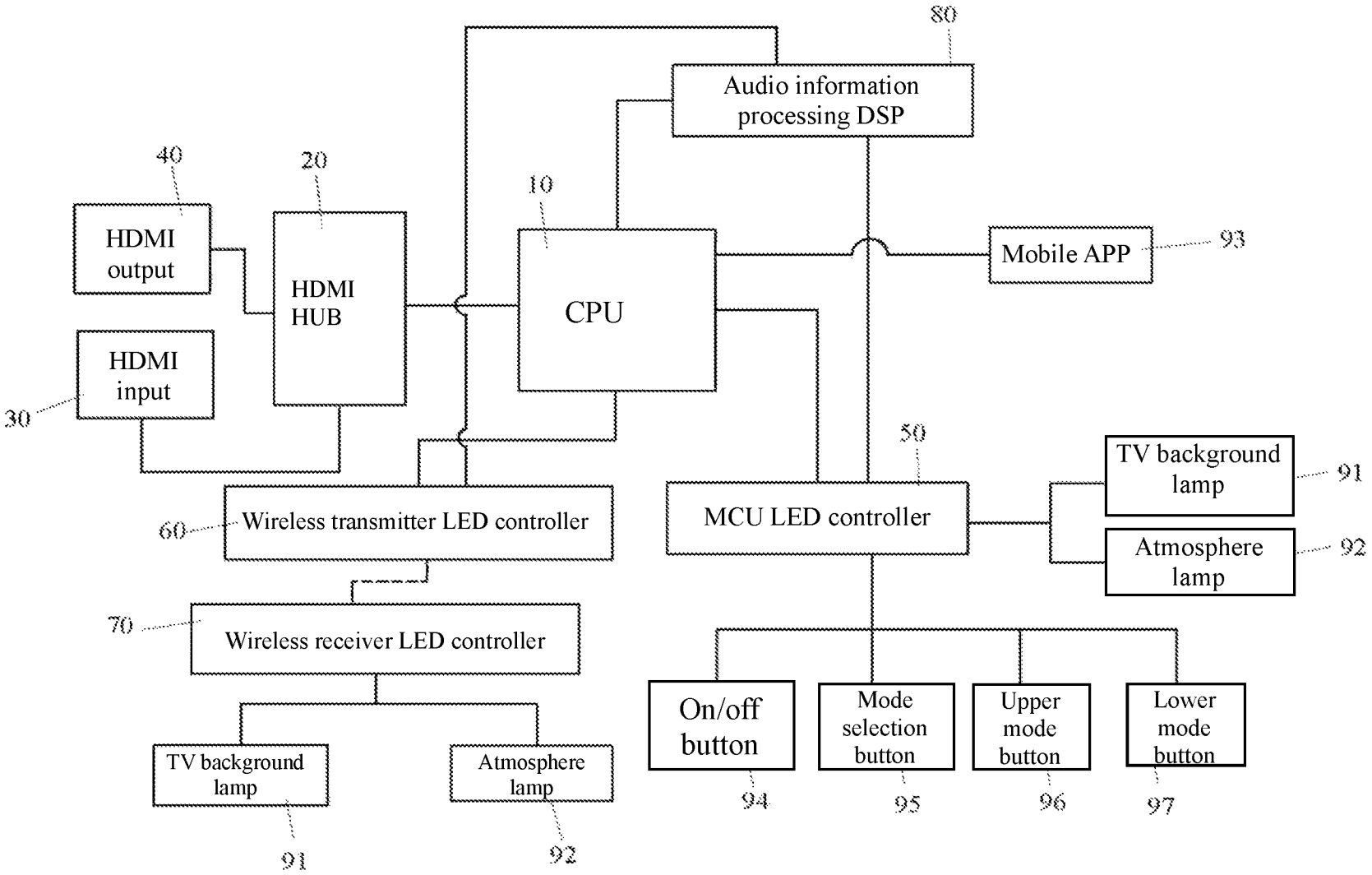
Audio information processing DSP
80
Mobile APP
93
CPU
10
HDMI HUB
20
HDMI output
40
HDMI input
30
MCU LED controller
50
TV background lamp
91
Atmosphere lamp
92
Mode selection button
95
Upper mode button
96
Lower mode button
97
On/off button
94
Wireless transmitter LED controller
60
Wireless receiver LED controller
70
Atmosphere lamp
92
TV background lamp
91

SYSTEM FOR PRODUCING MIXED REALITY ATMOSPHERE EFFECT WITH HDMI AUDIO/VIDEO STREAMING

TECHNICAL FIELD

The present invention relates to the technical field of atmosphere lamps, in particular to a system for producing a mixed reality atmosphere effect with HDMI audio/video streaming.

BACKGROUND

With an ability to create required atmospheres, atmosphere lamps (also known as LED atmosphere lamps) are an excellent choice for lighting at theme parks, hotels, homes and exhibitions, and other commercial and artistic lighting. People can customize their favorite lighting effects according to their own needs (such as requirements with regard to color, temperature, brightness and direction, etc.), and choose and control the brightness, gray scale and color changes of light in different spaces and at different times according to their needs and scene conditions.

At present, when people watch video content through a TV screen at home, a TV background lamp only provides a simple atmosphere mode, but cannot interact with the video content, nor with a surrounding lamp.

SUMMARY

In view of the defects of the existing technology, the present invention aims to provide a system and method for producing a mixed reality atmosphere effect with HDMI audio/video streaming, so as to interact with both video content and a nearby lamp.

To achieve the above objective, the present invention adopts the following technical scheme:

a system for producing a mixed reality atmosphere effect with HDMI audio/video streaming, the system including a CPU, an HDMI hub, an HDMI input, an HDMI output, an MCU LED controller, a wireless transmitter LED controller, a wireless receiver LED controller, an audio information processing DSP, a TV background lamp and an atmosphere lamp, where the HDMI hub is connected to the CPU; the HDMI input and the HDMI output are both connected to the HDMI hub, the MCU LED controller and the wireless transmitter LED controller are both connected to the CPU, and the wireless receiver LED controller is in wireless communication with the wireless transmitter LED controller; the audio information processing DSP is connected to the CPU, the MCU LED controller and the wireless transmitter LED controller; and the TV background lamp and the atmosphere lamp are both connected to the MCU LED controller and the wireless receiver LED controller.

Optionally, the CPU is also connected to a mobile APP.

Optionally, the MCU LED controller is also connected to an on/off button, a mode selection button, an upper mode button and a lower mode button.

Compared, with the existing technology, the present invention has obvious advantages and beneficial effects. Specifically, it can be known from the technical scheme that:

by adopting the system of the present invention, users can enjoy a more immersive atmosphere when watching video content, and by acquiring the video content and processing the video content, the TV background lamp and the atmosphere lamp can interact with the atmosphere of the video content, thus providing a more immersive user experience.

BRIEF DESCRIPTION OF DRAWINGS

FIG. 1 is a schematic diagram of a preferable embodiment of the present invention.

| List of reference numerals: | |
|---|---|
| 10. CPU | 20. HDMI hub |
| 30. HDMI input | 40. HDMI output |
| 50. MCU LED controller | 60. Wireless transmitter LED controller |
| 70. Wireless receiver LED controller | 80. Audio information processing DSP |
| 91. TV background lamp | 92. Atmosphere lamp |
| 93. Mobile APP | 94. On/off button |
| 95. Mode selection button | 96. Upper mode button |
| 97. Lower mode button | |

DETAILED DESCRIPTION

Referring to FIG. 1, which shows a specific structure of a system for producing a mixed reality atmosphere effect with HDMI audio/video streaming according to a preferred embodiment of the present invention. The system includes a CPU 10, an HDMI hub 20, an HDMI input 30, an HDMI output 40, an MCU LED controller 50, a wireless transmitter LED controller 60, a wireless receiver LED controller 70, an audio information processing DSP 80, a TV background lamp 91 and an atmosphere lamp 92.

The HDMI hub 20 is connected to the CPU 10. The HDMI input 30 and the HDMI output 40 are both connected to the HDMI hub 20, the MCU LED controller 50 and the wireless transmitter LED controller 60 are both connected to the CPU 10, and the wireless receiver LED controller 70 is in wireless communication with the wireless transmitter LED controller 60. The audio information processing DSP 80 is connected to the CPU 10, the MCU LED controller 50 and the wireless transmitter LED controller 60. The TV background lamp 91 and the atmosphere lamp 92 are both connected to the MCU LED controller 50 and the wireless receiver LED controller 70.

Further, the CPU 10 is also connected to a mobile APP 93, and the mobile APP is configured to control a length of the TV background lamp 91. The MCU LED controller 50 is also connected to an on/off button 94, a mode selection button 95, an upper mode button 96 and a lower mode button 97.

The present invention further discloses a method for producing a mixed reality atmosphere effect with HDMI audio/video streaming, which adopts the above system for producing a mixed reality atmosphere effect with HDMI audio/video streaming, including the following steps:

Step 1 acquiring HDMI audio/video data: 1. supplying data to a Switch through the HDMI input 30; 2. supplying, through one HDMI channel, data from the HDMI input 30 to the HDMI output 40 completely; 3. supplying, through one HDMI channel, the data from the HDMI input 30 to the CPU 10, and then inputting the data to the audio information processing DSP 80 for audio information processing;

Step 2: processing, by the audio information processing DSP 80, signal data from the HDMI input 30, and obtaining corresponding atmosphere lamp data;

1) conducting two-dimensional lighting effect processing according to changes between video frames, to realize synchronization with the top, bottom, left and right of a screen:

S1: detecting a current content theme atmosphere based on changes in the video streaming in chronological order:

S1.1, obtaining, by an algorithm, a basic color atmosphere value of current frames;

S1.2 determining a proportion of frames different from previous frames in terms of number;

S1.3, determining a proportion of frames different from previous frames in terms of amplitude;

S1.4, obtaining the current theme atmosphere according to the data obtained in the previous three steps with weightings, such as science and technology, Hollywood, family drama, natural scenery, interstellar voyage, DJ music, etc.;

S2: providing data of a current two-dimensional atmosphere lamp based on the changes in the video streaming in chronological order:

S2.1, obtaining, by an algorithm, basic data of the current frames;

obtaining critical points of variation of each row of data;

obtaining an average value of the critical points;

obtaining an average value of a current row;

obtaining the basic data according to the above data with relevant weightings;

S2.2, obtaining, by an algorithm, data of changes compared with the previous frames;

acquiring row change pixel bits of the current frames compared with the previous frames;

acquiring the number of changed rows of the current frames compared with the previous frames;

acquiring variation values of row changes of the current frame compared with the previous frames;

obtaining the data of changes according to the above data with relevant weightings;

S2.3, obtaining, by an algorithm, current data by weighting the two groups of data;

2) conducting three-dimensional lighting effect processing according to changes between video frames, to realize synchronization with a video;

S1: detecting a current content theme atmosphere based on changes in the video streaming in chronological order, such as science and technology, Hollywood, family drama, natural scenery, interstellar voyage, DJ music, etc.;

S1.1, obtaining, by an algorithm, a basic color atmosphere value of current frames;

S1.2, determining a proportion of frames different from previous frames in terms of number;

S1.3, determining a proportion of frames different from previous frames in terms of amplitude;

S1.4, obtaining the current theme atmosphere according to the data obtained in the previous three steps with weightings;

S2: acquiring, by an algorithm, a current viewing angle and corresponding three-dimensional data according to the sequential contents in the video streaming and current image data;

S2.1, conducting frequency domain transfer on data of current frames, and finding out a dividing line;

S2.2, deducing the viewing angle of a current scene according to the dividing line;

S2.3, deducing a three-dimensional scene (open\indoor) according to the dividing line and the viewing angle;

S2.4, obtaining data of a three-dimensional atmosphere lamp in all directions according to the scene;

S3: weighting the data of S1 and S2 to obtain the current data;

3) providing, by an algorithm, a change effect of the current atmosphere lamp according to data changes of audio streaming:

S1, obtaining a type of a current sound change:

S1.1, obtaining critical points of sound amplitude change values of each sound track;

S1.2, obtaining a sound type (explosion, celebration, silence, tension, horror) according to the changes;

S2, providing two-dimensional display data:

S2.1, providing planarization data (up, down, left and right) of stereo data;

S2.2, weighting the sound type and the current planarization data to obtain the current data;

S3, calculating three-dimensional atmosphere display data:

S3.1 weighting the sound type and the current stereo data to obtain the effect of the atmosphere lamp in all directions;

4) providing, by an algorithm, a current equipment vibration condition according to data changes of audio streaming:

S1, obtaining a type of a current sound change:

S1.1, obtaining critical points of sound amplitude change values of each sound track;

S1.2, obtaining a sound type (explosion, celebration, silence, tension, horror) according to the changes;

S2, providing vibration change data according to settings of each sound track:

S2.1, providing vibration data according to a type and a vibration condition of each sound track;

Step 3: transmitting corresponding data to corresponding atmosphere lamp equipment;

1) displaying the effect on the designated atmosphere lamp equipment through a wired port:

S1, setting, by an APP, a type of the wired port;

S2, supplying, by the audio information processing DSP 80, the corresponding data to the corresponding wired port according to the type of the wired port set by the APP;

S3, displaying the related effect, with the corresponding atmosphere lamp equipment;

2) displaying the effect on the designated atmosphere lamp equipment in a wireless manner;

S1, setting, by an APP, a current mode as a two-dimensional/three-dimensional mode;

S2, setting, by the APP, an orientation and position of the corresponding atmosphere lamp equipment;

S3, transmitting, by an audio/video processing unit, related atmosphere data;

S4, displaying, by the atmosphere lamp equipment, the related effect after receiving the atmosphere data according to the settings of the APP.

At present, the length of a TV background lamp may not match the size of a TV. During screen synchronization, a traditional way is to directly shortening a light strip, which brings about a compatibility problem of the TV. The invention can use the APP to adjust the number of lighted-up beads, so, as to make the length of the light strip compatible with the size of the 1V more directly.

The highlights of the design of the present invention are as follows: by adopting the system of the present invention, users can enjoy a more immersive atmosphere when watching video content. By acquiring the video content and processing the video content, the TV background lamp and the atmosphere lamp can interact with the atmosphere of the video content, thus providing a more immersive user experience.

The technical principle of the present invention has been described with reference to the specific embodiments above. These descriptions are only for explaining the principles of the present invention, and should not be construed as limiting the scope of protection of the present invention in any way. Based on the explanation here, other specific embodiments of the present invention are conceivable by those of ordinary skill in the art without creative effort, and all these embodiments fall within the scope of protection of the present invention.

The invention claimed is:

1. A system for producing a mixed reality atmosphere effect based on HDMI audio/video streaming, comprising:

a CPU, an HDMI hub, an HDMI input, an HDMI output, an MCU LED controller, a wireless transmitter LED controller, a wireless receiver LED controller, an audio information processing DSP, a TV background lamp and an atmosphere lamp; wherein the HDMI hub is directly connected to the CPU;

the HDMI input and the HDMI output are both directly connected to the HDMI hub, the MCU LED controller and the wireless transmitter LED controller are both directly connected to the CPU, and the wireless receiver LED controller is in wireless communication with the wireless transmitter LED controller; wherein HDMI audio/video data is fed to the HDMI hub through the HDMI input, and is fed through one HDMI channel from the HDMI input to the HDMI output completely; wherein the HDMI audio/video data is input to the audio information processing DSP for audio information processing; wherein the audio information processing DSP is directly connected to the CPU, the MCU LED controller and the wireless transmitter LED controller, wherein the audio information processing DSP is configured to process signal data fed from the HDMI input to obtain corresponding atmosphere lamp data; and wherein the TV background lamp and the atmosphere lamp are both directly connected to the MCU LED controller and the wireless receiver LED controller; wherein the audio information processing DSP is configured to process the signal data fed from the HDMI input to obtain corresponding atmosphere lamp data by:

performing two-dimensional lighting effect processing based on frame-by-frame changes between video frames, to realize synchronization with a top, bottom, left and right of the TV screen;

performing three-dimensional lighting effect processing based on frame-by-frame changes between video frames, to realize synchronization with the video;

providing, by an algorithm, a change effect of the current atmosphere lamp based on data changes of audio streaming; and providing, by an algorithm, a current equipment vibration condition based on data changes of audio streaming.

2. The system for producing a mixed reality atmosphere effect based on HDMI audio/video streaming of claim 1, wherein the CPU is further connected to a mobile APP.

3. The system for producing a mixed reality atmosphere effect based on HDMI audio/video streaming of claim 1, wherein the MCU LED controller is further connected to an on/off button, a mode selection button, an upper mode button and a lower mode button.

4. The system for producing a mixed reality atmosphere effect based on HDMI audio/video streaming of claim 1, wherein the audio information processing DSP is configured to perform the operation of performing two-dimensional lighting effect processing based on frame-by-frame changes between video frames, to realize synchronization with a top, bottom, left and right of the TV screen by: detecting a current content theme atmosphere based on changes in the video streaming in chronological order; and providing data of a current two-dimensional atmosphere lamp based on the changes in the video streaming in chronological order.

5. The system for producing a mixed reality atmosphere effect based on HDMI audio/video streaming of claim 4, wherein the audio information processing DSP is configured to perform the operation of detecting a current content theme atmosphere based on changes in the video streaming in chronological order by:

obtaining, by an algorithm, a basic color atmosphere value of current frames;

determining a proportion of frames different from previous frames in terms of number;

determining a proportion of frames different from previous frames in terms of amplitude;

obtaining the current theme atmosphere based on the data obtained in the previous three steps with weightings, wherein the current theme atmosphere comprises at least one selected from the group consisting of science and technology, Hollywood, family drama, natural scenery, interstellar voyage, and DJ music.

6. The system for producing a mixed reality atmosphere effect based on HDMI audio/video streaming of claim 4, wherein the audio information processing DSP is configured to perform the operation of providing data of a current two-dimensional atmosphere lamp based on the changes in the video streaming in chronological order by:

obtaining, by an algorithm, basic data of the current frames;

obtaining critical points of variation of each row of data;

obtaining an average value of the critical points;

obtaining an average value of a current row;

obtaining the basic data according to the above data with relevant weightings;

obtaining, by an algorithm, data of changes compared with the previous frames;

acquiring row change pixel bits of the current frames compared with the previous frames;

acquiring the number of changed rows of the current frames compared with the previous frames;

acquiring variation values of row changes of the current frame compared with the previous frames;

obtaining the data of changes according to the above data with relevant weightings; and obtaining, by an algorithm, current data by weighting the two groups of data.

7. The system for producing a mixed reality atmosphere effect based on HDMI audio/video streaming of claim 1, wherein the audio information processing DSP is configured to perform the operation of performing three-dimensional lighting effect processing based on frame-by-frame changes between video frames, to realize synchronization with the video by:

detecting a current content theme atmosphere based on changes in the video streaming in chronological order, the current content theme atmosphere comprising at least one selected from the group consisting of science and technology, Hollywood, family drama, natural scenery, interstellar voyage, and DJ music; acquiring, by an algorithm, a current viewing angle and corresponding three-dimensional data based on the sequential contents in the video streaming and current image data; and weighting the data in the above two steps to obtain the current data, in all directions according to the scene.

8. The system for producing a mixed reality atmosphere effect based on HDMI audio/video streaming of claim 7, wherein the audio information processing DSP is configured to perform the operation of detecting a current content theme atmosphere based on changes in the video streaming in chronological order by:

obtaining, by an algorithm, a basic color atmosphere value of current frames;

determining a proportion of frames different from previous frames in terms of number;

determining a proportion of frames different from previous frames in terms of amplitude; and obtaining the current theme atmosphere based on the data obtained in the previous three steps with weightings.

9. The system for producing a mixed reality atmosphere effect based on HDMI audio/video streaming of claim 7, wherein the audio information processing DSP is configured to perform the operation of acquiring, by an algorithm, a current viewing angle and corresponding three-dimensional data based on the sequential contents in the video streaming and current image data by:

performing frequency domain transfer on data of current frames, and finding out a dividing line;

deducing the viewing angle of a current scene according to the dividing line;

deducing a three-dimensional scene (open\indoor) based on the dividing line and the viewing angle; and obtaining data of a three-dimensional atmosphere lamp in all directions according to the scene.

10. The system for producing a mixed reality atmosphere effect based on HDMI audio/video streaming of claim 1, wherein the audio information processing DSP is configured to perform the operation of providing, by an algorithm, a change effect of the current atmosphere lamp based on data changes of audio streaming by:

obtaining a type of a current sound change; providing two-dimensional display data; calculating three-dimensional atmosphere display data.

11. The system for producing a mixed reality atmosphere effect based on HDMI audio/video streaming of claim 10, wherein the audio information processing DSP is configured to perform the operation of obtaining a type of a current sound change;

obtaining critical points of sound amplitude change values of each sound track; and obtaining a sound type according to the changes, the sound type comprising explosion, celebration, silence, tension, and horror.

12. The system for producing a mixed reality atmosphere effect based on HDMI audio/video streaming of claim 10, wherein the audio information processing DSP is configured to perform the operation of providing two-dimensional display data by:

providing planarization data, comprising up, down, left and right, of stereo data;

weighting the sound type and the current planarization data to obtain the current data; and weighting the sound type and the current stereo data to obtain the effect of the atmosphere lamp in all directions.

13. The system for producing a mixed reality atmosphere effect based on HDMI audio/video streaming of claim 1, wherein the audio information processing DSP is configured to perform the operation of providing, by an algorithm, a current equipment vibration condition based on data changes of audio streaming by:

obtaining a type of a current sound change; providing vibration change data according to settings of each sound track, comprising.

14. The system for producing a mixed reality atmosphere effect based on HDMI audio/video streaming of claim 13, wherein the audio information processing DSP is configured to perform the operation of S1 of obtaining a type of a current sound change by:

obtaining critical points of sound amplitude change values of each sound track; and obtaining a sound type according to the changes, the sound type comprising explosion, celebration, silence, tension, horror.

15. The system for producing a mixed reality atmosphere effect based on HDMI audio/video streaming of claim 13, wherein the audio information processing DSP is configured to perform the operation of S2 of providing vibration change data according to settings of each sound track, by:

providing vibration data according to a type and a vibration condition of each sound track.

16. The system for producing a mixed reality atmosphere effect based on HDMI audio/video streaming of claim 1, wherein after performing the operations recited in claim 1, the audio information processing DSP is configured to transmit corresponding data to corresponding atmosphere lamp equipment by:

displaying the effect on the designated atmosphere lamp equipment through a wired port; and displaying the effect on the designated atmosphere lamp equipment in a wireless manner.

17. The system for producing a mixed reality atmosphere effect based on HDMI audio/video streaming of claim 16, wherein the audio information processing DSP is configured to perform the operation of displaying the effect on the designated atmosphere lamp equipment through a wired port by:

setting, by an APP, a type of the wired port;

supplying, by the audio information processing DSP, the corresponding data to the corresponding wired port according to the type of the wired port set by the APP;

displaying the related effect with the corresponding atmosphere lamp equipment.

18. The system for producing a mixed reality atmosphere effect based on HDMI audio/video streaming of claim 16, wherein the audio information processing DSP is configured to perform the operation of displaying the effect on the designated atmosphere lamp equipment in a wireless manner by:

setting, by an APP, a current mode as a two-dimensional/three-dimensional mode;

setting, by the APP, an orientation and position of the corresponding atmosphere lamp equipment;

transmitting, by an audio/video processing unit, related atmosphere data;

displaying, by the atmosphere lamp equipment, the related effect after receiving the atmosphere data according to the settings of the APP.

* * * * *